US005190412A

United States Patent [19]

Salvatore

[11] Patent Number: 5,190,412

[45] Date of Patent: Mar. 2, 1993

[54] QUICK ASSEMBLY MODULAR FRAME

[75] Inventor: Philip A. Salvatore, Leonia, N.J.

[73] Assignee: The Brooklyn Union Gas Company, Brooklyn, N.Y.

[21] Appl. No.: 864,642

[22] Filed: Apr. 7, 1992

[51] Int. Cl.[5] ..... E02D 17/08

[52] U.S. Cl. ..... 405/272; 405/282

[58] Field of Search ..... 405/282, 283, 133, 272, 405/273

[56] References Cited

U.S. PATENT DOCUMENTS

| | | | |
|---|---|---|---|
| 924,153 | 6/1909 | Elliott | 405/272 X |
| 1,297,960 | 3/1919 | Yourtee | 405/272 X |
| 1,331,186 | 2/1920 | De Garay | 405/272 X |
| 2,482,367 | 9/1949 | Ravers | 405/282 |
| 3,393,521 | 7/1968 | Cammisa | 405/282 |
| 4,685,837 | 8/1987 | Cicanese | 405/282 |
| 5,080,533 | 1/1992 | Cooper | 405/282 |

FOREIGN PATENT DOCUMENTS

| | | | |
|---|---|---|---|
| 65821 | 4/1983 | Japan | 405/282 |
| 1076537 | 2/1984 | U.S.S.R. | 405/282 |

*Primary Examiner*—David H. Corbin

*Attorney, Agent, or Firm*—Paul W. Garbo

[57] ABSTRACT

A framing module for quickly assembling frames of rectangular towers suitable for supporting protective shields within excavations comprises a horizontal wale connected by hinge to a vertical leg and a locking brace to hold the hinged members in the right angle position. The wale has a tenon and set-back at each end. The hinged end of the leg is adjacent a set-back in the wale and that set-back becomes a mortise when the leg is set at right angle to the wale. The tenon of one module is inserted in the mortise of another module to interlock the modules. A rectangular frame is easily formed with at least four interlocked modules, and duplicate frames can be stacked to reach a desired tower height.

14 Claims, 2 Drawing Sheets

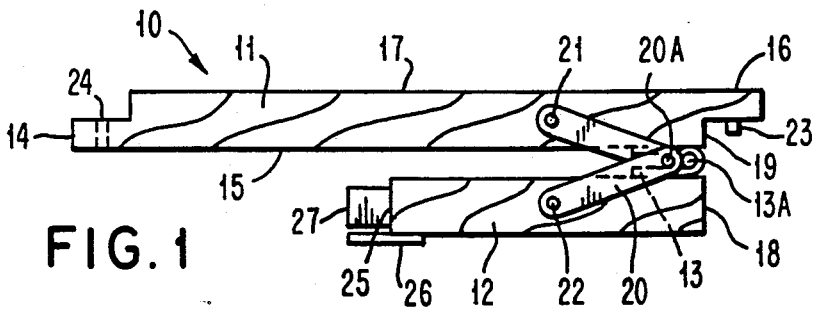
FIG. 1
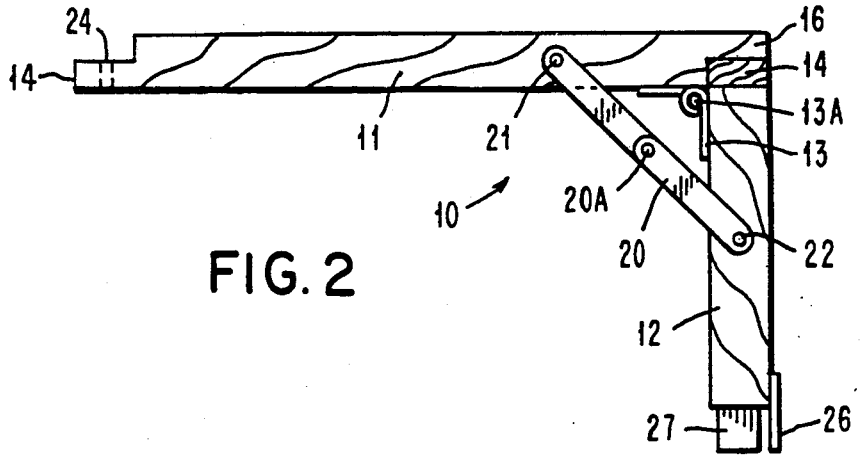
FIG. 2
FIG. 3
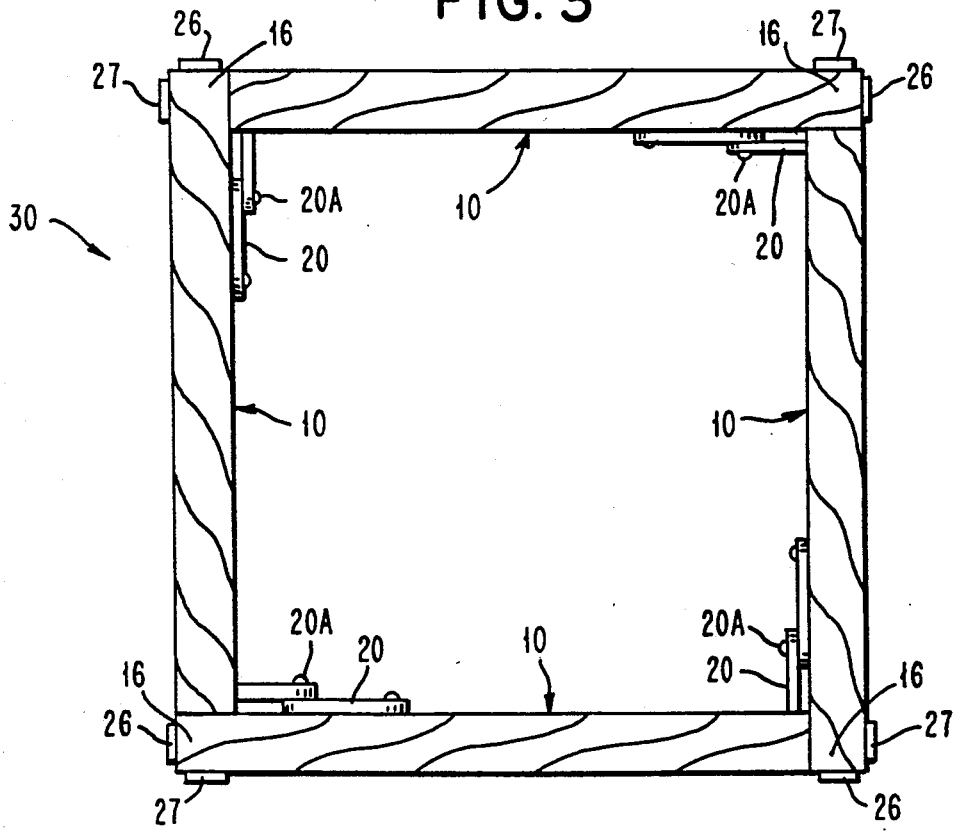

FIG. 4
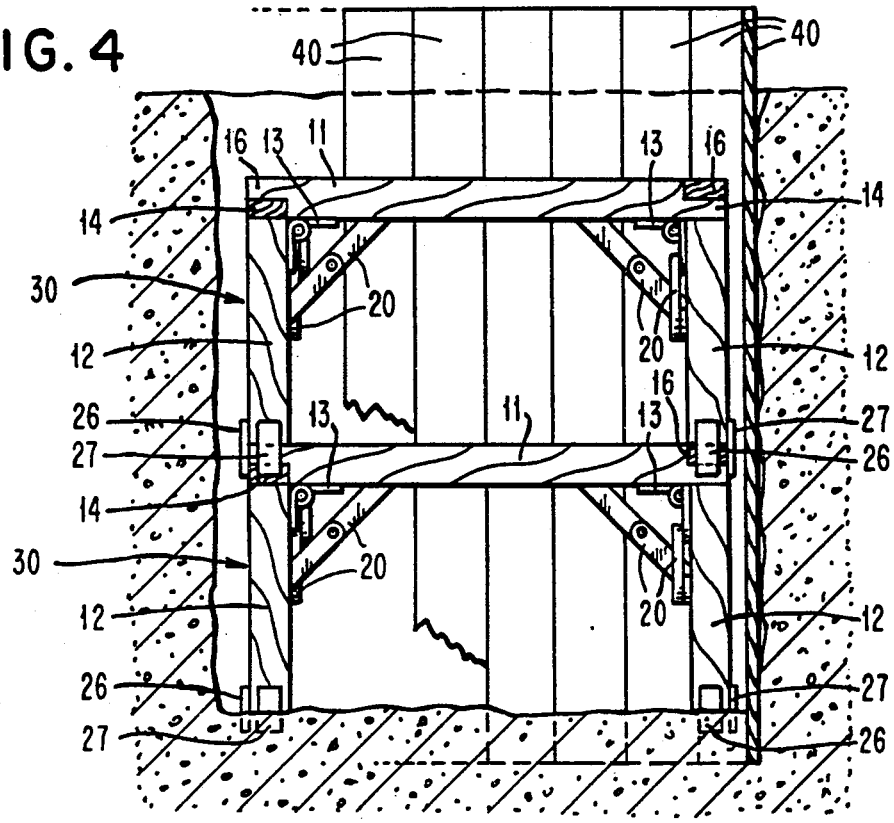
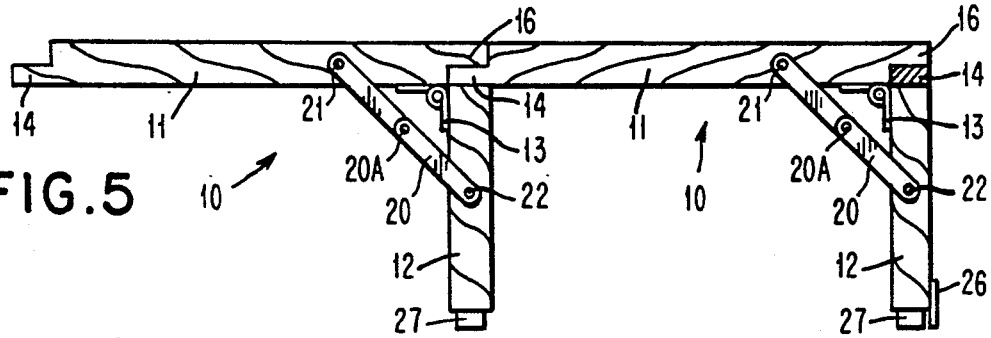
FIG. 5
FIG. 6
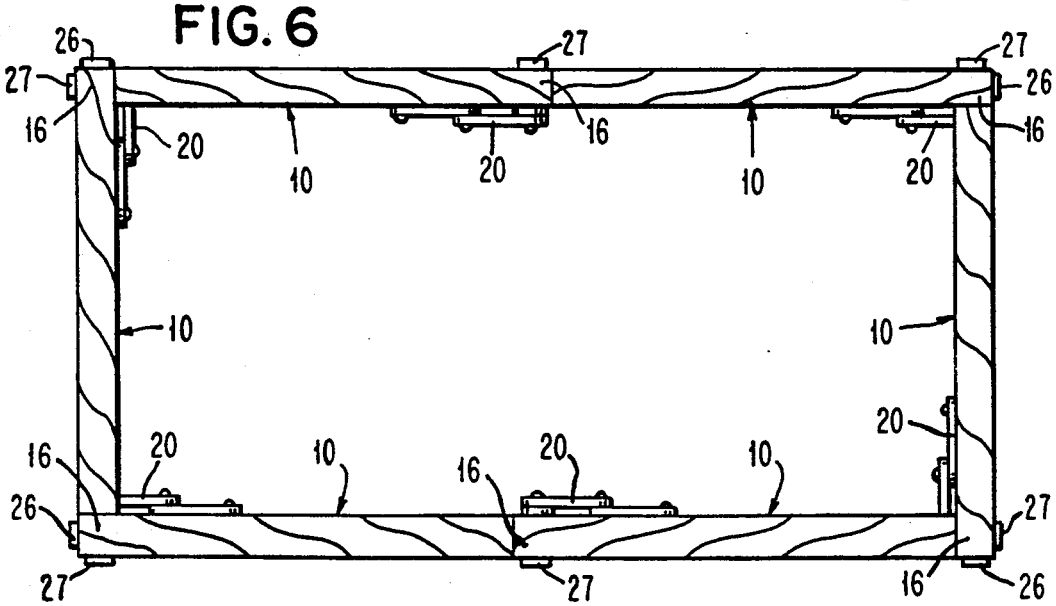

QUICK ASSEMBLY MODULAR FRAME

BACKGROUND OF THE INVENTION

This invention relates to a hinged device for forming a quadrilateral frame with a leg at each of its four corners. More particularly, the hinged device is especially useful for the quick assembly of a four-sided tubular frame within an excavation so that sheeting placed vertically against the outer edges of the frame will provide a protective enclosure against cave-in of the excavation.

Usually, excavators will improvise protection against cave-in by driving planks and sheeting into the soil at the bottom of the excavation and providing bracing members between planks positioned along opposite sides of the excavation. Such improvization requires much labor and time.

Many proposals have been made for the erection of protective shields within excavations. For example, recent U.S. Pat. No. 5,080,533 to Cooper shows a safety shield for an excavation consisting of vertical columns with horizontal steps to support horizontal sidewall members. Additionally, transverse bracing members are placed between the columns positioned along opposed sides of the excavation. U.S. Pat. No. 3,393,521 to Cammisa discloses a shoring frame having a basic component in the form of a vertical T-beam with T-sections welded to the opposite ends of the T-beam. Transverse braces have hooked plates on their ends to engage the T-sections. This hardware requires longitudinal timbers to complete the shoring frame. Both patents illustrate the failure of prior proposals to use a single, simple module that is readily interlocked with several such modules to form a shoring frame.

In spite of the diversity of structures that have been proposed to prevent cave-ins of excavations, none appears to have been simple enough to gain widespread use.

It is therefore a principal object of this invention to provide a simple module that can easily and quickly be used to assemble a quadrilateral tubular frame to support sheeting placed thereagainst.

Another important object is to provide such a module that is formed by merely a pair of hinged bars.

These and other features and advantages of the invention will be apparent from the description which follows.

SUMMARY OF THE INVENTION

In accordance with this invention, a module for assembling the frame of a quadrilateral tower comprises a pair of hinged bars that can be swung to form a right angle therebetween. One bar will be called the leg and the other the wale. Each of the opposite ends of the wale is partially cut away to provide a projection or tenon and a set-back. The tenon and set-back at one end of the wale are inverted relative to the other tenon and set-back. The leg is attached by a hinge to the wale so that the hinge pin lies along the edge of a set-back. Thus, when the wale and leg are swung into a right angle arrangement, the end of the leg and the set-back of the wale adjacent to the hinge form a slot or mortise that can receive and hold the tenon of another module.

Preferably, the mortise should have a fastener to ensure that the tenon inserted therein cannot slip out. A dowel or steel pin set in the tenon or in the leg end forming the mortise are simple but effective forms of such fastener. Of course, the tenon inserted into a mortise equipped with a pin must have a hole into which the pin fits. Conversely, the tenon inserted into a mortise may have a pin set therein to enter a hole in the leg end and/or the tenon forming the mortise.

A locking brace extending from the wale to the leg of the module serves to hold the right angle configuration. A metal bar fastened to both the wale and leg while in the right angle position is a simple locking brace. Locking braces of various forms for hinged members are well known.

The free end of the leg is preferably equipped with stacking guide means for properly placing and holding the leg in alignment with the leg of another module on which the first-mentioned leg is superimposed or stacked. A steel angle projecting from the free end of the leg along its outside corner or steel plates projecting from the faces of the leg that form its outside corner are practical stacking guides.

BRIEF DESCRIPTION OF THE DRAWINGS

For further clarification of the invention, the ensuing description will refer to the appended drawings of which:

FIG. 1 is a front view of a wooden embodiment of the framing module of the invention, shown in its collapsed or closed condition;

FIG. 2 is a front view of the framing module of FIG. 1, shown in its extended or open condition and including part of a similar module held in the hinged corner thereof;

FIG. 3 is a top view of four modules like that of FIG. 2 which are connected to form a square frame;

FIG. 4 is a front view of the frame of FIG. 3, shown superimposed on a duplicate frame within an excavation;

FIG. 5 is a front view of two identical modules like that of FIG. 2, showing the modules connected in aligned position; and FIG. 6 is a top view of two pairs of aligned modules connected to two single modules to form a rectangular frame.

DESCRIPTION OF PREFERRED EMBODIMENTS

FIGS. 1 and 2 show that the framing module 10 of the invention has wale 11 connected to leg 12 by hinge 13. As a specific example, 4×4-inch lumber is used for wale 11 and leg 12. One end of wale 11 has tenon 14 extending along the bottom side or face 15 of wale 11. The other end of wale 11 has tenon 16 extending along the top side 17 of wale 11. In the specified example, wale 11 with tenons 14,16 has an overall length of 48 inches and leg 12 is 22 inches long.

Hinge 13 is screwed to leg 12 with its pin 13A adjacent end 18 of leg 12 and is screwed to face 15 of wale 11 so that hinge pin 13A is adjacent set-back 19 that is alongside tenon 16. Foldable but locking brace 20 has two arms pivotally held together by pin 20A. One brace arm is pivotally fastened to wale 11 and the other arm is pivotally fastened to leg 12 at points 21 and 22, respectively, which are reasonably spaced from hinge pin 13A, for example, 10 or 12 inches.

Steel pin 23 is centrally set in tenon 16 and projects into the space of set-back 19. Tenon 14 has hole 24 passing centrally therethrough so that pin 23 of a duplicate module 10 will fit hole 24 to give positive interlocking between wales 11 of two modules 10.

Free end 25 of leg 12 has stacking guide plates 26, 27 fastened, respectively, to the face opposite that with hinge 13 and to the face opposite that with locking brace 20. A steel angle can be substituted for guide plates 26,27.

In FIG. 2, the hinged portion of module 10 is shown locked in the open or right angle formation by brace 20. FIG. 2 also shows tenon 14 of a duplicate module captured between tenon 16 and leg 12 of module 10. Wale 11 of the duplicate module (not shown) would extend vertically outward from FIG. 2.

Four modules 10 are locked together to form square frame 30 of FIG. 3. Tenon 16 near brace 20 of each module 10 overlaps tenon 14 (not visible) of another module 10 and interlocks modules 10 at right angles to one another. Guide stacking plates 26,27 of each module 10 appear on the outer periphery of frame 30 while braces 20 are on its inner periphery. Inasmuch as planks and sheeting are dropped vertically along the outer periphery of frame 30, it is advisable to have braces 20 on the inner periphery to avoid damage thereto. Of course, modules 10 can be assembled into a frame like frame 30 where braces 20 are on the outer periphery. In such case, guide plates 26,27 of each leg 12 are attached to the faces thereof opposite those shown in FIG. 1.

FIG. 4 shows a sectional elevation of an excavation in which duplicate frames 30 of FIG. 3 have been stacked. It will be noted that right legs 12 have guide plates 26 on the front and plates 27 on the outer side, whereas left legs 12 have guide plates 27 on the front and plates 26 on the outer side. Plates 26,27 of top frame 30 overlap and lock it on lower frame 30. Plates 26,27 of bottom frame 30 dig into the soil at the bottom of the excavation and thus stabilize the stacked frames 30.

In the right corner of each frame 30, brace 20 appears edgewise on the inner face of front leg 12, diagonal brace 20 on rear leg 12 appears in back of edgewise brace 20 and hinge 13 of rear leg 12 is partially visible behind both braces 20. At the left corner of each frame 30, hinge 13 of front leg 12 appears ahead of diagonal brace 20 on front leg 12 and further back is edgewise brace 20 attached to rear leg 12.

FIG. 4 also shows several planks 40 positioned in the excavation against the outer face of the rear wales 11 of stacked frames 30 as well as against the outer face of wales 11 on the right side of frames 30. As illustrated in FIG. 4, it is advisable to drive the bottom ends of planks 40 into the soil around the bottom of the excavation to help hold planks 40 in the desired position. While FIG. 4 shows a stack of two frames 30, three or more frames 30 can be stacked when needed.

Two framing modules 10 are interlocked in FIG. 5 in alignment rather than at right angle to one another. Assuming that dual modules 10 of FIG. 5 are to be superimposed on a duplicate arrangement, guide plate 26 of left leg 12 has been removed so that the bottom end of left leg 12 can abut and rest on the lower duplicate arrangement of modules 10.

FIG. 6 illustrates a rectangular frame formed with two opposed dual modules 10 as shown in FIG. 5 connected at their ends by single modules 10. The six modules 10 forming the rectangular frame have the same dimensions; for example, wale 11 is 42 inches long and leg 12 is 24 inches. However, the single modules 10 might have wales 11 with an overall length of 50 inches to make the width of the working space within the frame broader. Similarly, dual wales 11 of FIG. 5 may have different lengths. While wales 11 used in any four-sided frame may have different lengths, legs 12 of all the modules 10 in any frame should have the same length because they are like the legs of any table. All of the edge of brace 20 at the juncture of each pair of aligned modules 10 is visible in FIG. 6 but the edges of braces 20 at the four corners of the frame are partly hidden by modules 10 positioned at right angles to braces 20.

The wale and leg of the new framing module are easily made of lumber but other practical materials including metals and rigid synthetics such as those used to form boat hulls, may be used. Also, the wale and leg may have different cross-sectional dimensions; for example, one may be 4×4 inches and the other 2×4 inches.

Variations and modifications of the invention as illustrated herein will be apparent to those skilled in the art without departing from the spirit or scope of the invention. For instance, locking brace 20 shown in FIGS. 1 and 2 may be a unitary bar pivotally attached to wale 11 and notched at its loose end for capture in a catch attached to leg 12 when module 10 is in the open formation. Various other forms of locking brace are available for use in module 10. Similarly, stacking guide plates 26,27 or an angle-iron may be replaced by a spike in the end of leg 12 to fit in a hole of tenon 16 of a module 10 that will support leg 12 when placed thereon. Accordingly, only such limitations should be imposed on the invention as are set forth in the appended claims.

What is claimed is:

1. A framing module for assembling the frame of a rectangular tower which comprises a horizontal wale having at one end a first tenon extending along the top of said wale and a first set-back along the bottom of said wale and having at the other end a second tenon extending along the bottom of said wale and a second set-back along the top of said wale, a vertical leg, a hinge connected to said wale with the hinge pin positioned along the edge of said first set-back and connected to said leg with said hinge pin positioned along the top end of said leg, and a locking brace extending diagonally from said wale to said leg to hold said wale at right angle to said leg and form a mortise between said first tenon and the top end of said leg.

2. The framing module of claim 1 wherein the locking brace comprises two pivotally connected bars with one of said bars pivotally connected to the wale of said module and the other of said bars pivotally connected to the leg of said module.

3. The framing module of claim 1 wherein a fastener is provided to prevent escape of the second tenon of another module captured in the mortise formed between the first tenon and leg of said module.

4. The framing module of claim 3 wherein the fastener comprises a pin extending downwardly from the first tenon and a receptive hole for said pin in the second tenon of said module.

5. The framing module of claim 1 wherein the bottom end of the leg is provided with stacking guide means to help align said leg with the leg of another subjacent module.

6. The framing module of claim 5 wherein the stacking guide means is formed by two steel plates attached to two adjacent faces of the leg to project beyond the end of said leg.

7. The framing module of claim 6 wherein the wale and leg are made of square lumber, the first tenon has a pin extending downwardly therefrom and the second tenon has a receptive hole for said pin.

8. The frame of a rectangular tower formed by at least four of the framing module of claim 1 with the wales of said modules assembled in a rectangle with the second tenon of each said module held in the mortise formed by the first tenon and leg of the adjoining module in said rectangle.

9. The frame of claim 8 wherein the leg of each module has stacking guide means projecting beyond the bottom end thereof.

10. The frame of claim 9 wherein at least one duplicate frame is stacked thereon with the legs of each superimposed frame individually aligned with the legs of the subjacent frame.

11. The frame of claim 10 wherein the wale and leg of each module are made of square lumber, and a fastener is provided to prevent escape of the second tenon of each module from the mortise formed between the first tenon and leg of another module.

12. The frame of claim 8 wherein each of two opposite sides thereof is formed by at least two modules assembled rectilinearly with the second tenon of one module held in the mortise formed by the first tenon and leg of the adjoining module.

13. The frame of claim 8 wherein the first tenon of each wale has a pin extending downwardly therefrom and the second tenon of each wale has a receptive hole for said pin.

14. The frame of claim 12 wherein the first tenon of each wale has a pin extending downwardly therefrom and the second tenon of each wale has a receptive hole for said pin.

* * * * *